US011785994B2

(12) United States Patent
Voigt et al.

(10) Patent No.: US 11,785,994 B2
(45) Date of Patent: Oct. 17, 2023

(54) GARMENTS INCLUDING SIZE ADJUSTMENT SYSTEMS

(71) Applicant: Shock Doctor, Inc., Fountain Valley, CA (US)

(72) Inventors: Katherine Voigt, Millersville, MD (US); Anna Marie Olinger, Costa Mesa, CA (US); Adam Peter Karl, IV, Burlington, VT (US); James Creath Frazier, Hinesburg, VT (US)

(73) Assignee: SHOCK DOCTOR, INC., Fountain Valley, CA (US)

( * ) Notice: Subject to any disclaimer, the term of this patent is extended or adjusted under 35 U.S.C. 154(b) by 34 days.

(21) Appl. No.: 17/057,054

(22) PCT Filed: May 22, 2019

(86) PCT No.: PCT/US2019/033542
§ 371 (c)(1),
(2) Date: Nov. 19, 2020

(87) PCT Pub. No.: WO2019/226781
PCT Pub. Date: Nov. 28, 2019

(65) Prior Publication Data

US 2021/0204619 A1 Jul. 8, 2021

Related U.S. Application Data

(60) Provisional application No. 62/674,836, filed on May 22, 2019.

(51) Int. Cl.

| | |
|---|---|
| ***A41D 1/04*** | (2006.01) |
| ***A41D 13/00*** | (2006.01) |
| ***A41D 15/00*** | (2006.01) |

(52) U.S. Cl.
CPC ..... *A41D 1/04* (2013.01); *A41D 13/0015* (2013.01); *A41D 15/00* (2013.01); *A41D 2600/10* (2013.01)

(58) Field of Classification Search
CPC ..... A41D 13/0518; A41D 13/0587; A41C 3/0028; A41C 3/0057
See application file for complete search history.

(56) References Cited

U.S. PATENT DOCUMENTS 5,328,398 A * 7/1994 Aubrey ..... A61F 5/028 441/106
6,138,277 A * 10/2000 Gillen ..... A41D 13/015 2/463

(Continued)

FOREIGN PATENT DOCUMENTS

GB 0454838 A 10/1936
WO 2009/096933 A1 8/2009

OTHER PUBLICATIONS

International Preliminary Reporton Patentability received for PCT Patent Application No. PCT/US2019/033542, dated Dec. 3, 2020, 9 pages.

(Continued)

*Primary Examiner* — Heather Mangine
*Assistant Examiner* — Matthew R Marchewka
(74) *Attorney, Agent, or Firm* — Faegre Drinker Biddle & Reath LLP

(57) ABSTRACT

A garment includes a first garment portion including a pocket, and the pocket includes an opening. A second garment portion is movable relative to the first garment portion. An adjustment system is at least partially disposed within the pocket and couples the second garment portion and the first garment portion. The adjustment system is manipulable by the wearer to move the second garment (Continued)

portion at least partially into the pocket via the opening to thereby adjust a fit of the garment on the wearer.

12 Claims, 10 Drawing Sheets

(56) References Cited

U.S. PATENT DOCUMENTS 6,280,287 B1 * 8/2001 Keith ..... A41F 1/006 450/41
7,757,308 B2 * 7/2010 Oomae ..... A41F 9/025 2/221
9,462,833 B1 * 10/2016 Spaulding ..... A41D 7/005
2001/0050492 A1 * 12/2001 Janevski ..... B60R 21/12 2/97
2006/0223414 A1 * 10/2006 Staub ..... A41C 3/0057 450/1
2010/0287681 A1 * 11/2010 Storms, Jr. ..... F41H 1/02 2/102
2011/0009793 A1 1/2011 Lucero et al.
2013/0185853 A1 * 7/2013 Ricart ..... A41D 13/0531 224/259
2015/0079876 A1 * 3/2015 Betts ..... A41C 3/0057 450/78
2015/0282545 A1 10/2015 Shaw et al.
2016/0044976 A1 * 2/2016 Nykoluk ..... A41D 13/0568 2/2.5
2018/0184733 A1 * 7/2018 LeMarbe ..... A41D 1/04
2019/0037930 A1 * 2/2019 Rendone ..... A41C 3/00
2020/0037673 A1 * 2/2020 Storelli ..... A41C 3/0057

OTHER PUBLICATIONS

International Search Report and Written Opinion received for PCT Patent Application No. PCT/US2019/033542, dated Aug. 27, 2019, 10 pages.

* cited by examiner

GARMENTS INCLUDING SIZE ADJUSTMENT SYSTEMS

CROSS-REFERENCE TO RELATED APPLICATION

The present application claims the benefit of and priority to U.S. Provisional Application Ser. No. 62/674,836, filed on May 22, 2018, which is hereby incorporated herein by reference in its entirety for all that it teaches and for all purposes.

TECHNICAL FIELD

The present invention relates to garments worn during physical activities. More specifically, the present invention relates to size-adjustable garment worn during physical activities.

BACKGROUND

Loosely fitting garments worn during physical activities, such as running, walking, hiking, and the like, can be subjected to excessive movement, which can be uncomfortable, distracting, and/or detrimental to performance of the wearer. These issues can be exacerbated for garments that include pockets for carrying personal items, such as keys, wallets, phones, water bottles, and the like, which can also be subjected to excessive movement. Accordingly, some individuals prefer to wear snugly fitting garments during physical activities. However, garments are typically manufactured in several standard sizes (for example, XXS, XS, S, M, L, XL, and XXL), and the standard sizes do not provide a snug fit for all individuals.

SUMMARY

In a first example, a garment according to the present disclosure includes a first garment portion including a pocket, and the pocket includes an opening. A second garment portion is movable relative to the first garment portion. An adjustment system is at least partially disposed within the pocket and couples the second garment portion and the first garment portion. The adjustment system is manipulable by the wearer to move the second garment portion at least partially into the pocket via the opening to thereby adjust a fit of the garment on the wearer.

In a second example, the adjustment system of the garment of the first example is manipulable by the wearer to move the second garment portion at least partially into the pocket via the opening to thereby adjust a girth size of the garment on the wearer.

In a third example, the adjustment system of the garment of any of the preceding examples is pullable by the wearer to move the second garment portion at least partially into the pocket via the opening to thereby adjust the fit of the garment on the wearer.

In a fourth example, the adjustment system of the garment of any of the preceding examples includes a sliplock buckle that is coupled to the first garment portion. A strap is coupled to the second garment portion and slidably extends through the sliplock buckle. The strap is pullable through the sliplock buckle to move the second garment portion at least partially into the pocket via the opening to thereby adjust the fit of the garment on the wearer.

In a fifth example, the adjustment system of the garment of any of the preceding examples includes a guide element coupled to the first garment portion and slidably coupled to the second garment portion.

In a sixth example, the guide element of the garment of any of the preceding examples is a guide strap.

In a seventh example, the garment of any of the preceding examples further includes a third garment portion coupled to the second garment portion, and the guide strap is coupled to the third garment portion.

In an eighth example, the garment of any of the preceding examples, wherein the first garment portion is configured to engage a front of the wearer, the second garment portion is configured to engage a side of the wearer, and the third garment portion is configured to engage a back of the wearer.

In a ninth example, the garment of any of the preceding examples, wherein the second garment portion includes a first material having a first elastic modulus, the third garment portion includes a second material having a second elastic modulus, and the second elastic modulus is less than the first elastic modulus.

In a tenth example, the garment of any of the preceding examples, wherein the guide element is a first guide element, and further including a second guide element coupled to the first garment portion and slidably coupled to the second garment portion.

In an eleventh example, the garment of any of the preceding examples, wherein the first guide element is a first guide strap and the second guide element is a second guide strap.

In a twelfth example, the garment of any of the preceding examples further including a third guide element coupled to the second garment portion and slidably coupled to the first garment portion.

In a thirteenth example, the garment of any of the preceding examples, wherein the first guide element is a first guide strap, the second guide element is a second guide strap, and the third guide element is a third guide strap.

In a fourteenth example, the garment of any of the preceding examples, wherein the sliplock buckle is a first sliplock buckle, the adjustment system further includes a second sliplock buckle coupled to the first garment portion, and the strap includes: a first end coupled to the second garment portion; a second end coupled to the second garment portion; a handle garment portion disposed between the first end and the second end and between the first sliplock buckle and the second sliplock buckle. The handle garment portion is pullable to move the strap through the first sliplock buckle and the second sliplock buckle to move the second garment portion at least partially into the pocket via the opening to thereby adjust the fit of the garment on the wearer.

In a fifteenth example, the garment of any of the preceding examples, wherein the opening is a first opening, the pocket further including a second opening.

In a sixteenth example, a garment according to the present disclosure includes a first garment portion including a pocket, and the pocket includes an opening. The garment further includes a second garment portion. An adjustment system is at least partially disposed within the pocket. The adjustment system includes a guide element coupled to the first garment portion and slidably coupled to the second garment portion such that the second garment portion is movable at least partially into the pocket via the opening to thereby adjust a fit of the garment on the wearer.

In a seventeenth example, the guide element of the garment of the sixteenth example is a guide strap.

In an eighteenth example, the garment of the sixteenth example or the seventeenth example, wherein the guide element is a first guide element, and further including a second guide element coupled to the first garment portion and slidably coupled to the second garment portion.

In a nineteenth example, the garment of any of the sixteenth example through the eighteenth example, wherein the first guide element is a first guide strap, and the second guide element is a second guide strap.

In a twentieth example, the garment of any of the sixteenth example through the nineteenth example further includes a third guide element coupled to the second garment portion and slidably coupled to the first garment portion.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

FIG. 2B is the same as FIG. 2A, except several components are hidden so that other components are visible.

Figure 1B:
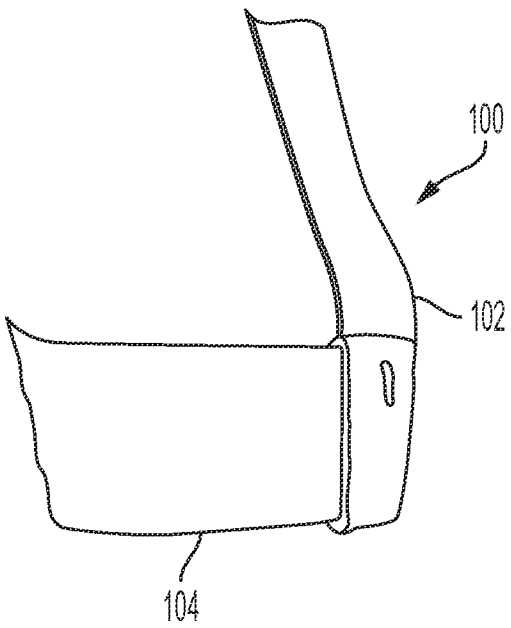
FIG. 1B is another side view of the size-adjustable garment of FIG. 1A upon adjusting and tightening the fit of the garment on the wearer.

It should be understood that the drawings are intended facilitate understanding of exemplary embodiments of the present invention are not necessarily to scale.

DETAILED DESCRIPTION

The following description refers to the accompanying drawings which show specific embodiments. Although specific embodiments are shown and described, it is to be understood that additional or alternative features are employed in other embodiments. The following detailed description is not to be taken in a limiting sense, and the scope of the claimed invention is defined by the appended claims and their equivalents.

It should be understood that like reference numerals are intended to identify the same structural components, elements, portions, or surfaces consistently throughout the several drawing figures, as such components, elements, portions, or surfaces may be further described or explained by the entire written specification, of which this detailed description is an integral part. Unless otherwise indicated, the drawings are intended to be read (for example, cross-hatching, arrangement of parts, proportion, degree, etc.) together with the specification, and are to be considered a portion of the written description.

Figure 1A:
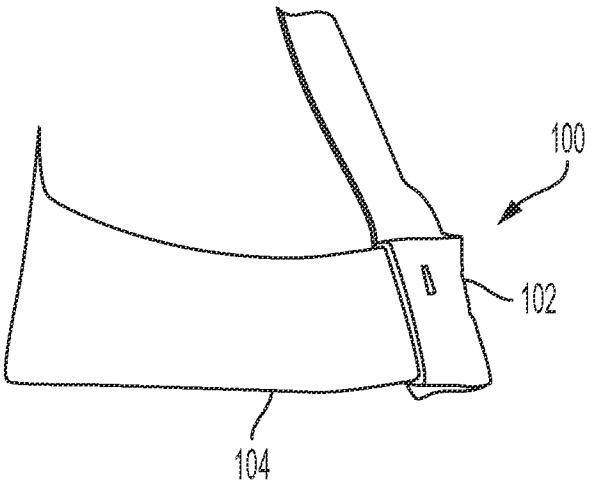
FIG. 1A is a side view of a size-adjustable garment according to an embodiment of the present disclosure prior to adjusting and tightening the fit of the garment on a wearer.

FIGS. 1A and 1B illustrate a size-adjustable garment 100 according to an embodiment of the present disclosure. Generally, the size-adjustable garment 100 includes a first garment portion 102 that is configured to engage the front right of the torso of a wearer, a second garment portion 104 that is configured to engage the right side of the torso of the wearer, and a third garment portion 106 that is configured to engage the back of the torso of the wearer. The size-adjustable garment 100 also includes a fourth garment portion (shown elsewhere) that is configured to engage the left side of the torso of the wearer and a firth garment portion (shown elsewhere) that is configured to engage the front left of the torso of the wearer. The second garment portion 104 is movable (more specifically, translatable) relative to the first garment portion 102 and the fourth garment portion is movable (more specifically, translatable) relative to the fifth garment portion to adjust the size of the garment 100 (specifically, the torso circumferential size or girth size of the garment 100). As shown in FIG. 1A, the garment 100 may be loosened to facilitate donning or removing the garment 100. As shown in FIG. 1B, the garment 100 may be tightened around the torso of the wearer to provide a snug fit for wearers having various body sizes. For example, the garment 100 may be adjusted to provide a snug fit for wearers having body sizes ranging from XXS-M, or L-XXL. A snug fit may be appropriate for wearing the garment 100 during various types of physical activities, such as running, walking, hiking, and the like. The above and additional aspects of the garment 100 are described in further detail below.

Generally, the size-adjustable garment 100 may include one or more materials, such as textiles, and more specifically textiles including synthetic fibers (for example, fibers comprising polyesters, polyamides, polyether-polyurea copolymers, and the like), natural fibers (for example, fibers comprising cotton, silk, wool, linen, and the like), or combinations thereof. In some embodiments, the size-adjustable garment 100 may include two or more materials that have different physical properties, such as elasticity. This aspect of the garment 100 is described in further detail below.

Figure 2A:
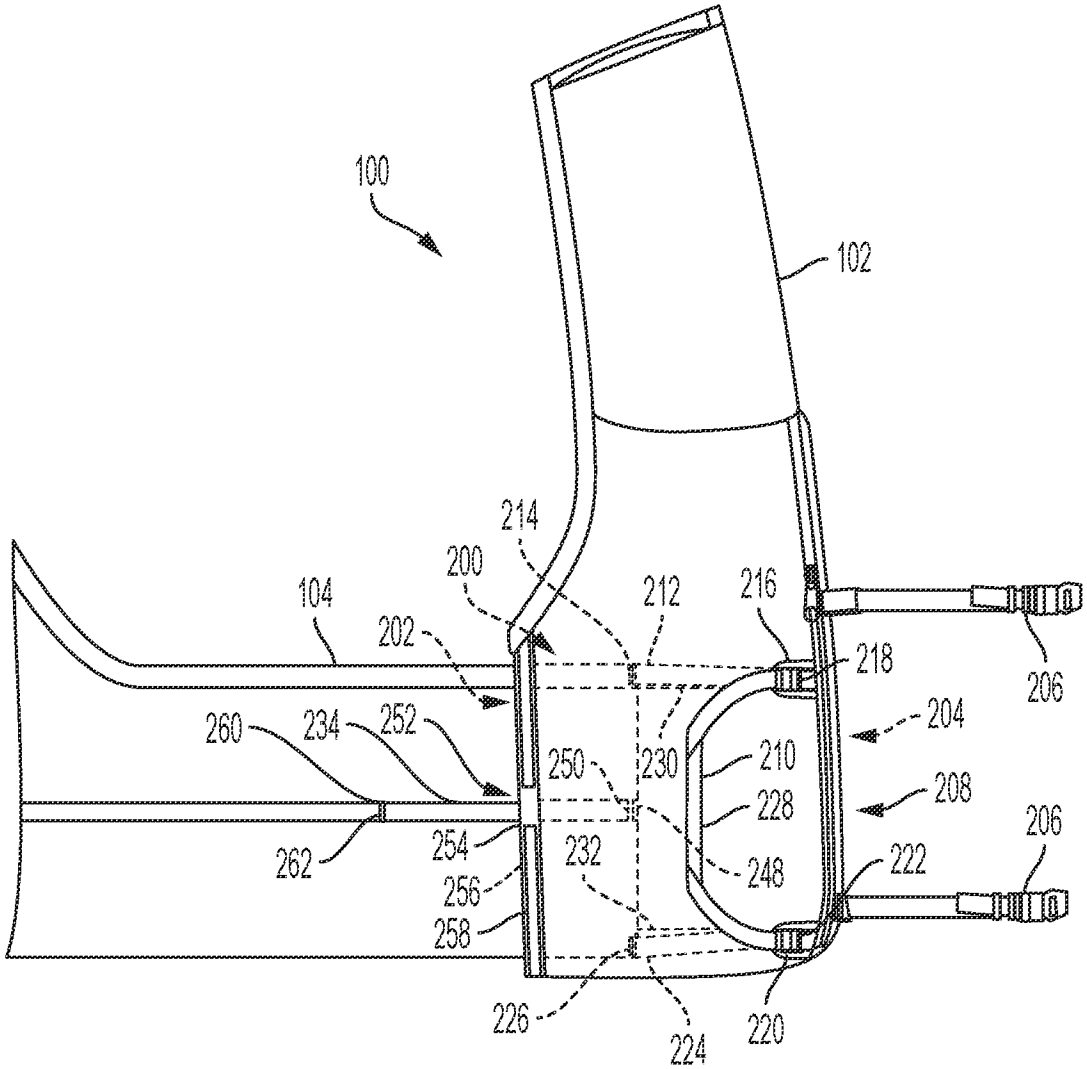
FIG. 2A is a side view of the size-adjustable garment of FIG. 1A; a portion of the garment is translucent to illustrate internal components.
Figure 2B:
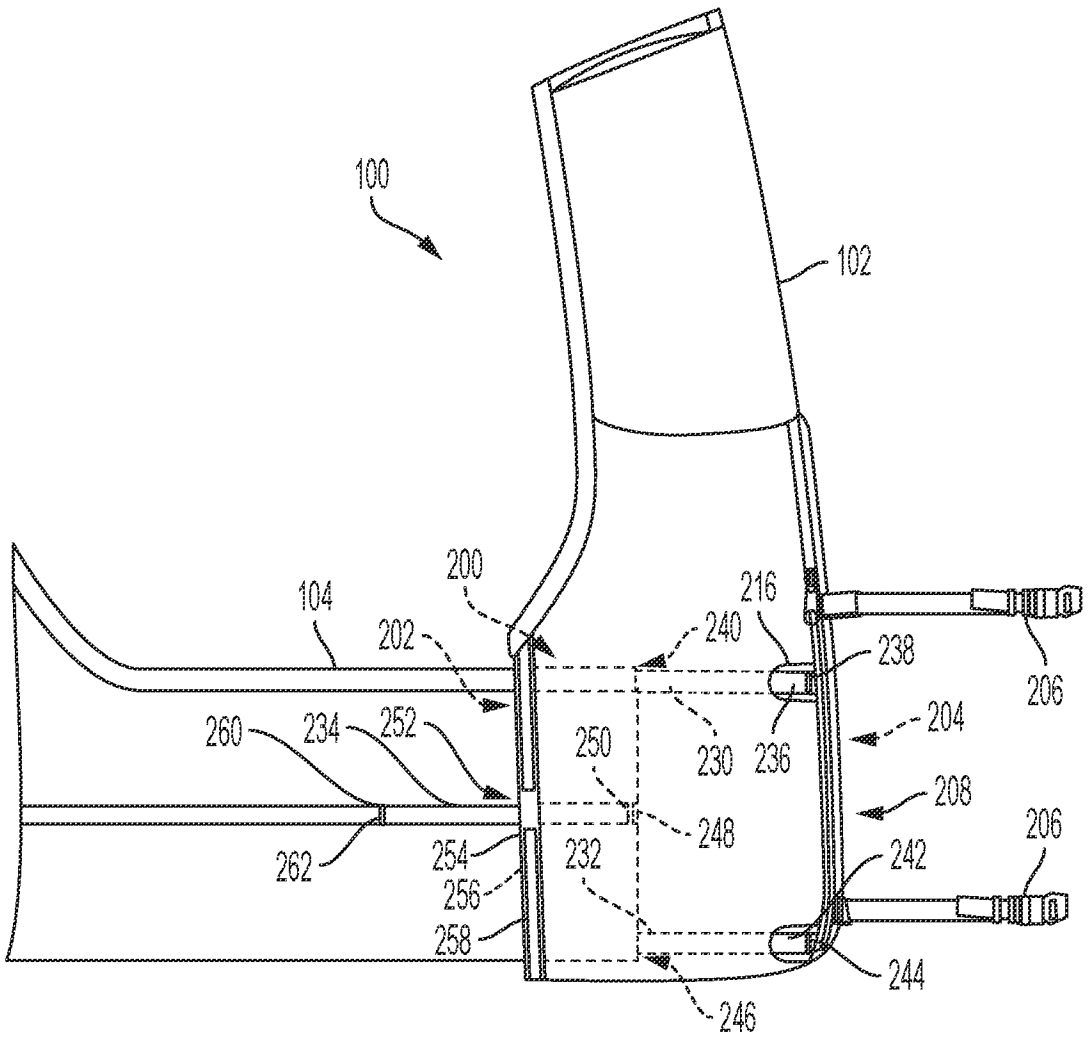
FIG. 2B is another side view of the size-adjustable garment of FIG. 1A.

FIGS. 2A and 2B further illustrate the first garment portion 102, the second garment portion 104, and the third garment portion 106 of the size-adjustable garment 100. In FIG. 2B, several components are hidden so that other components are visible, but FIG. 2B is otherwise the same as FIG. 2A. The first garment portion 102 includes a pocket 200 that is accessible via a first, or lateral, opening 202. The second garment portion 104 may move into and be partially disposed within the pocket 200 to adjust the fit of the garment 100 on the wearer, as generally described above. The first garment portion 102 also includes a second, or medial, opening 204 that facilitates access to the pocket 200. The second opening 204 may be used to place various items (for example, keys, identification cards, mobile phones, and the like) within the pocket 200. Near the second opening 204, the first garment portion 102 also includes attachment features 206 for detachably coupling to the fifth garment portion.

The garment 100 includes an adjustment system 208 to facilitate moving the second garment portion 104 relative to the first garment portion 102 and thereby adjust the fit of the garment 100 on the wearer. The adjustment system 208 is manipulable by the wearer to move the second garment portion 104 into the pocket 200 to adjust the fit of the garment 100 on the wearer.

The adjustment system 208 includes an adjustment strap 210 (hidden in FIG. 2B; for example, a textile strap) that is pullable by the wearer to move the second garment portion 104 into the pocket 200. The adjustment strap 210 includes a first, or upper, end 212 that is disposed within the pocket 200 and coupled to the second garment portion 104. In some embodiments and as illustrated, the first end 212 may couple to the second garment portion 104 via stitching 214. In other embodiments, the first end 212 may couple to the second garment portion 104 in other manners, such as via adhesives, ultrasonic welding, or the like. The adjustment strap 210 extends from the first end 212 through a first aperture 216 formed in the first garment portion 102 and a first sliplock buckle 218 coupled to the first garment portion 102. The adjustment strap 210 then extends from the first sliplock buckle 218 through a second aperture 220 formed in the first garment portion 102 and a second sliplock buckle 222 coupled to the first garment portion 102. The adjustment strap 210 then extends to a second, or lower, end 224 that is disposed within the pocket 200 and coupled to the second garment portion 104. In some embodiments and as illustrated, the second end 224 may couple to the second garment portion 104 via stitching 226. In other embodiments, the second end 224 may couple to the second garment portion 104 in other manners, such as via adhesives, ultrasonic welding, or the like. Between the first sliplock buckle 218 and the second sliplock buckle 222, the adjustment strap 210 defines a handle garment portion 228 that is pullable toward the second garment portion 104 to move the adjustment strap 210 through the first sliplock buckle 218 and the second sliplock buckle 222. This action causes the adjustment strap 210 to pull and move the second garment portion 104 at least partially into the pocket 200 via the first opening 202 to thereby tighten the fit of the garment 100 on the wearer. To loosen the fit of the garment 100 on the wearer, the first sliplock buckle 218 and the second sliplock buckle 222 may be pivoted to permit the adjustment strap 210 to slide therethrough.

The adjustment system 208 further includes one or more guide elements that facilitate moving the second garment portion 104 relative to the first garment portion 102 and inhibit the second garment portion 104 from deforming (specifically, wrinkling or folding upon itself) when moving relative to the first garment portion 102. Specifically, the adjustment system 208 includes a first, or upper, guide element, a second, or lower, guide element, and a third, or intermediate, guide element. The first guide element may be a first guide strap 230, the second guide element may be a second guide strap 232, and the third guide element may be a third guide strap 234 (for example, textile straps).

The first guide strap 230 includes a first end 236 (see FIG. 2B) that couples to the first garment portion 102 (for example and as illustrated, via stitching 238; alternatively, via adhesives, ultrasonic welding, or the like) and a second end (not shown) that couples to the third garment portion 106. The first guide strap 230 is slidably coupled to the second garment portion 104 by being received in a first internal passageway 240 (see FIG. 2B) of the second garment portion 104 (for example, formed between two textile sheets of the second garment portion 104).

The second guide strap 232 includes a first end 242 (see FIG. 2B) that couples to the first garment portion 102 (for example and as illustrated, via stitching 244; alternatively, via adhesives, ultrasonic welding, or the like) and a second end (not shown) that couples to the third garment portion 106. The second guide strap 232 is slidably coupled to the second garment portion 104 by being received in a second internal passageway 246 of the second garment portion 104 (for example, formed between two textile sheets of the second garment portion 104).

The third guide strap 234 includes a first end 248 that couples to the second garment portion 104 (for example and as illustrated, via stitching 250; alternatively, via adhesives, ultrasonic welding, or the like) and a second end (not shown) that couples to the third garment portion 106. The third guide strap 234 is slidably coupled to the first garment portion 102 by extending through an aperture 252 formed in the first garment portion 102 (for example, formed between two straps 254, 256 of the second garment portion 104, the straps 254, 256 being coupled, for example, via stitching 258, apart from the aperture 252) adjacent to the first opening 202. The third guide strap 234 also couples to the second garment portion 104 at an intermediate location 260 (for example and as illustrated, via stitching 262; alternatively, via adhesives, ultrasonic welding, or the like). By being coupled to the second garment portion 104 at the intermediate location 260 and the first end, the third guide strap 234 limits the range of motion of the second garment portion 104 relative to the first garment portion 102. That is, when the fit of the garment 100 is loosened, the stitching 250 at the first end of the third guide strap 234 engages the straps 254, 256 defining the aperture 252 to inhibit the second garment portion 104 from completely exiting the pocket 200. Similarly, when the fit of the garment 100 is tightened, the stitching 262 at the intermediate position of the third guide strap 234 engages the straps 254, 256 defining the aperture 252 to inhibit the second garment portion 104 from being moved further into the pocket 200. This aspect is described in further detail below.

FIGS. 2A and 2B do not illustrate the fourth garment portion and the fifth garment portion of the size-adjustable garment 100. However, the fourth garment portion, the fifth garment portion, and an adjustment system coupling the two garment portions may be the mirror image, or substantially the mirror image, of the second garment portion 104, the first garment portion 102, and the adjustment system 208, respectively.

Figure 3:
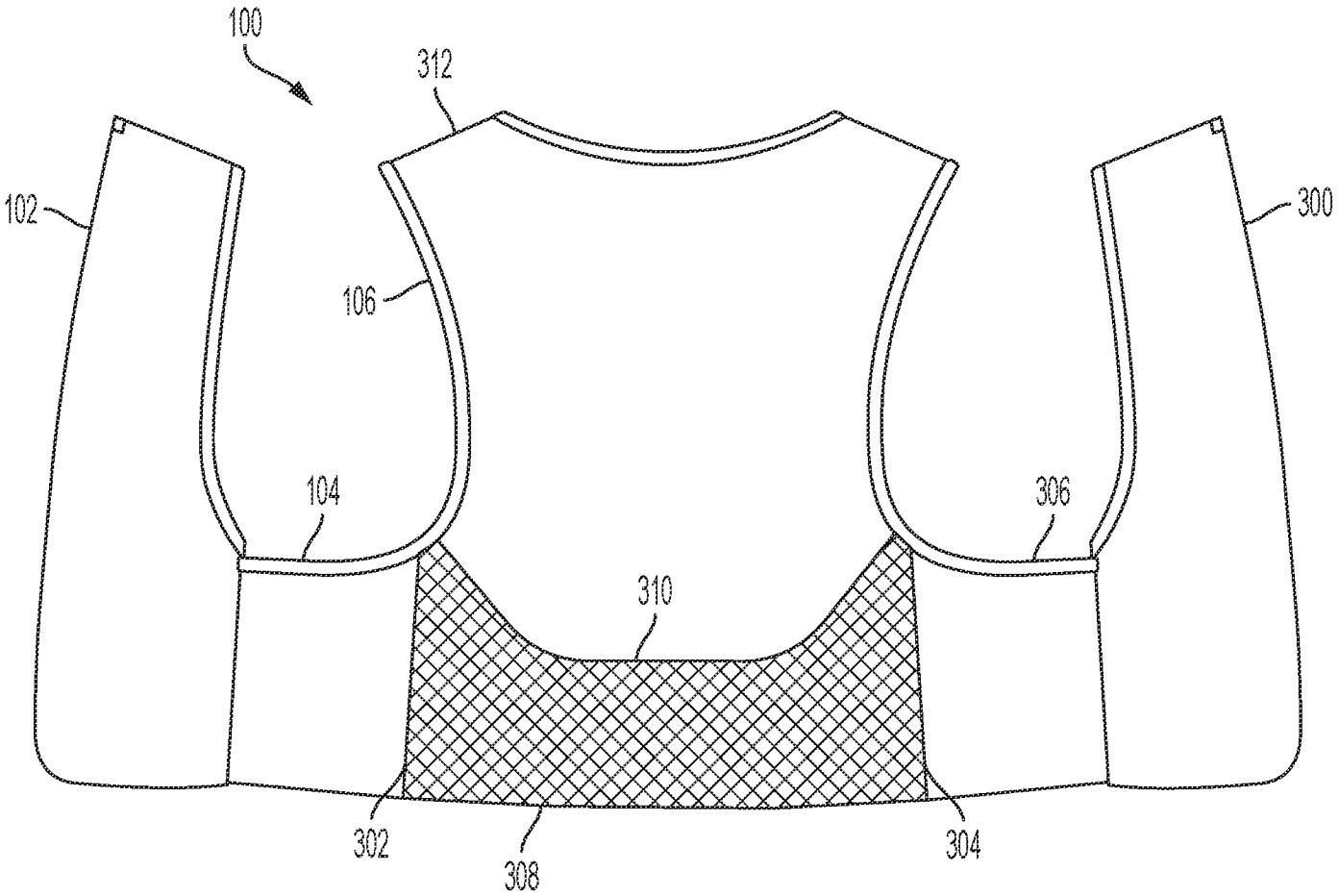
FIG. 3 is a partially-exploded front view of the interior of the size-adjustable garment of FIG. 1A.

FIG. 3 illustrates a partially-exploded front view of the interior of the size-adjustable garment 100 of FIG. 1A. The first garment portion 102 and the fifth garment portion 300 are normally coupled to the third garment portion 106 at the shoulders of the garment 100 (for example, via stitching (not shown), adhesives, ultrasonic welding, or the like), although FIG. 3 illustrates those components being uncoupled for clarity.

Stitching 302 and 304 couples the second garment portion 104 and the fourth garment portion 306, respectively, to a relatively-elastic section 308 of the third garment portion 106 that is configured to engage the lower back of the wearer. The relatively-elastic section 308 stretches as the second garment portion 104 and the fourth garment portion 306 move into the first garment portion 102 and the fifth garment portion 300, respectively, to tighten the fit of the garment 100 on the wearer. This stretching permits the second garment portion 104 and the fourth garment portion 306 to remain generally undeformed (that is, free of wrinkles and folds) regardless of the tightness of the fit of the garment 100 on the wearer. The relatively-elastic section 308 may include one or more of various materials, such as the textiles described above, and more specifically materials used to form two-way stretch fabrics or four-way stretch fabrics. The relatively-elastic section 308 may be formed of a material that has an elastic modulus that is less than the elastic modulus of a material of another garment portion of the garment 100 (for example, a material forming the second garment portion 104 and/or the fourth garment portion 306). Specifically, the elastic modulus of the relatively-elastic section 308 may be at least 10 percent less than the elastic modulus of the other material, more specifically at least 20 percent less than the elastic modulus of the other material, and more even more specifically at least 30 percent less than the elastic modulus of the other material.

The relatively-elastic section 308 couples to the second ends (not shown) of the first guide strap 230, the second guide strap 232, and the third guide strap 234 (shown elsewhere) and the second ends of guide straps of the adjustment system on the left side (not shown) of the garment 100. In some embodiments and as illustrated, the stitching 302 may couple the second ends (not shown) of the first guide strap 230, the second guide strap 232, and the third guide strap 234 (shown elsewhere) to the relatively-elastic section 308, and the stitching 304 may couple the second ends of guide straps of the adjustment system on the left side (not shown) of the garment 100 to the relatively-elastic section 308. In other embodiments, the relatively-elastic section 308 to couples the second ends of the guide straps in other manners, such as via adhesives, ultrasonic welding, or the like.

The relatively-elastic section 308 couples (for example, via stitching 310; alternatively, via adhesives, ultrasonic welding, or the like) to a relatively-inelastic section 312 that is configured to engage the upper back of the wearer. The relatively-inelastic section 312 may include one or more of various materials, such as the textiles described above.

As described above, the relatively-elastic section 308 stretches as the second garment portion 104 and the fourth garment portion 306 move into the first garment portion 102 and the fifth garment portion 300, respectively, to tighten the fit of the garment 100 on the wearer. As such, the stitching 302 and 304 and the second ends of the first and second guide straps 230 and 232 also move toward the front of the garment 100 and become relatively loose. The limited range of motion of the second garment portion 104 and the fourth garment portion 306 relative to the first garment portion 102 and the fifth garment portion 300, respectively, due to the presence of the stitching 260 on the third guide strap 234, inhibits the first and second guide straps 230 and 232 from becoming excessively loose.

Figure 4:
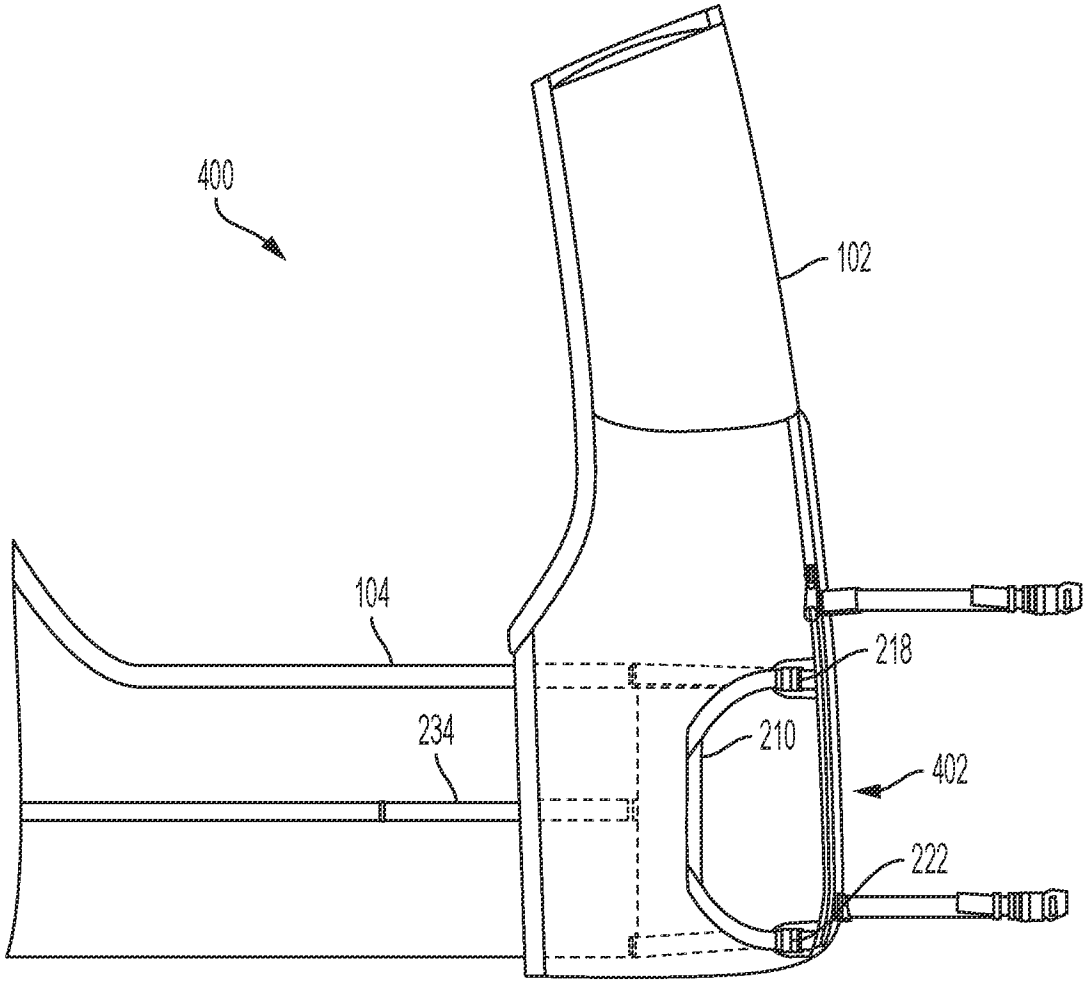
FIG. 4 is a side view of a size-adjustable garment according to another embodiment of the present disclosure.

Embodiments of size-adjustable garments according to the present disclosure may take various other forms. For example, adjustment systems of size-adjustable garments according to the present disclosure may take various other forms. As a specific example, FIG. 4 illustrates a size-adjustable garment 400 according to another embodiment of the present disclosure. The size-adjustable garment 400 may include the same components, or substantially the same components, as the garment 100, except for the adjustment system 402 that facilitates moving the second garment portion 104 relative to the first garment portion 102. Generally, the adjustment system 402 includes the adjustment strap 210, the first sliplock buckle 218, the second sliplock buckle 222, and the intermediate guide strap 234 described above. However, the adjustment system 402 lacks the upper guide strap 230 (shown elsewhere and described above) and the lower guide member 232 (shown elsewhere and described above).

Figure 5:
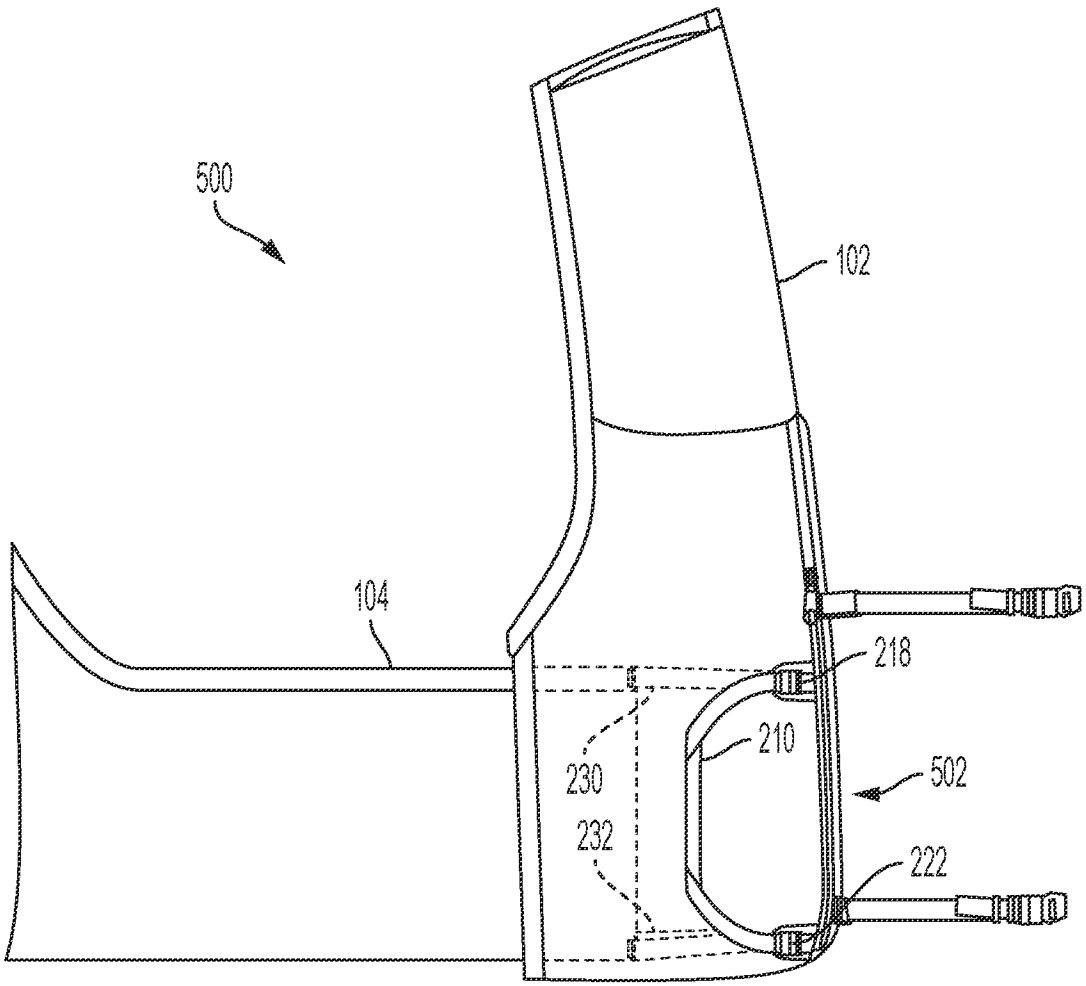
FIG. 5 is a side view of a size-adjustable garment according to another embodiment of the present disclosure.

As another specific example, FIG. 5 illustrates a size-adjustable garment 500 according to another embodiment of the present disclosure. The size-adjustable garment 500 may include the same components, or substantially the same components, as the garment 100, except for an adjustment system 502 that facilitates moving the second garment portion 104 relative to the first garment portion 102. Generally, the adjustment system 502 includes the adjustment strap 210, the first sliplock buckle 218, the second sliplock buckle 222, the upper guide strap 230, and the lower guide strap 232 described above. However, the adjustment system 502 lacks the intermediate guide strap 234 (shown elsewhere and described above).

Figure 6:
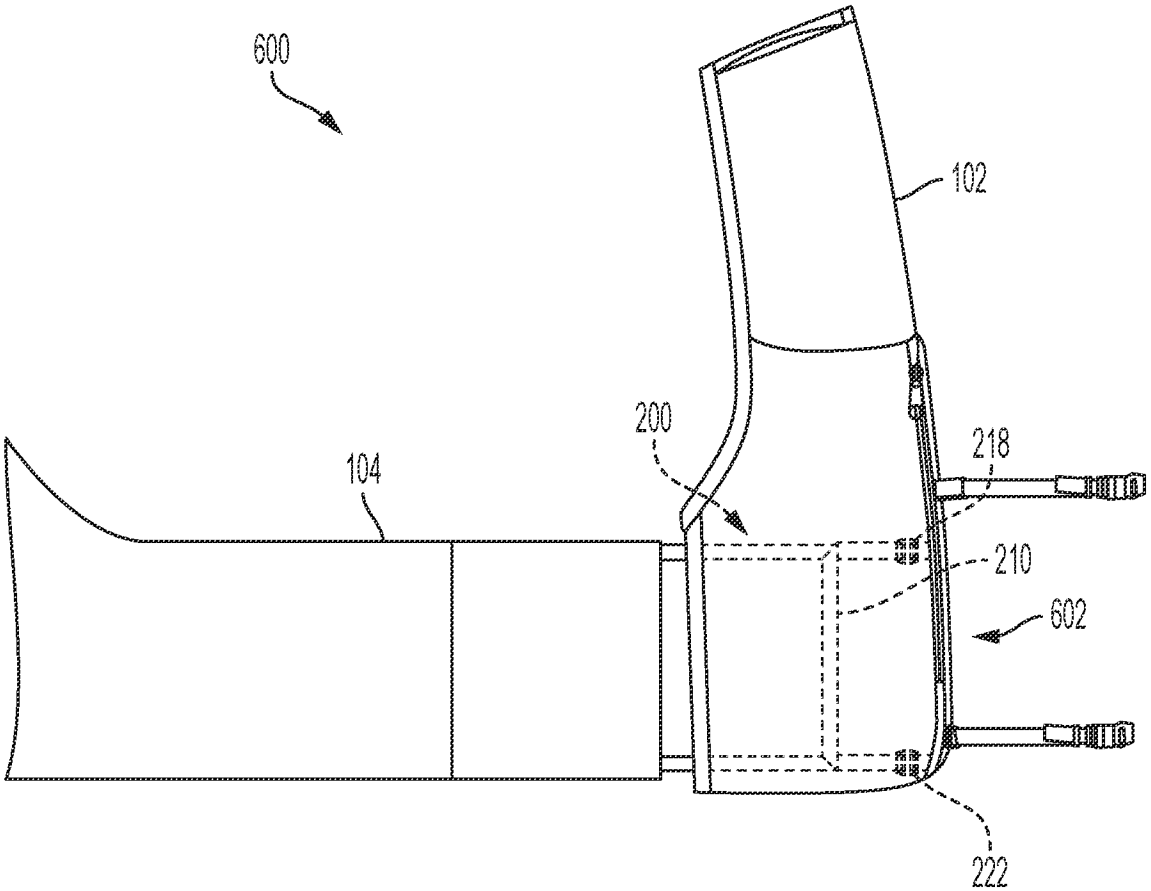
FIG. 6 is a partially-exploded side view of a size-adjustable garment according to another embodiment of the present disclosure.

As another specific example, FIG. 6 illustrates a size-adjustable garment 600 according to another embodiment of the present disclosure. The size-adjustable garment 600 may include the same components, or substantially the same components, as the garment 100, except for an adjustment system 602 that facilitates moving the second garment portion 104 relative to the first garment portion 102. Generally, the adjustment system 602 includes the adjustment strap 210, the first sliplock buckle 218, and the second sliplock buckle 222 described above. These components are disposed within the pocket 200, but are otherwise as described above. The adjustment system 602 lacks the upper guide strap 230 (shown elsewhere and described above), the lower guide strap 232 (shown elsewhere and described above), and the intermediate guide strap 234 (shown elsewhere and described above).

Figure 7A:
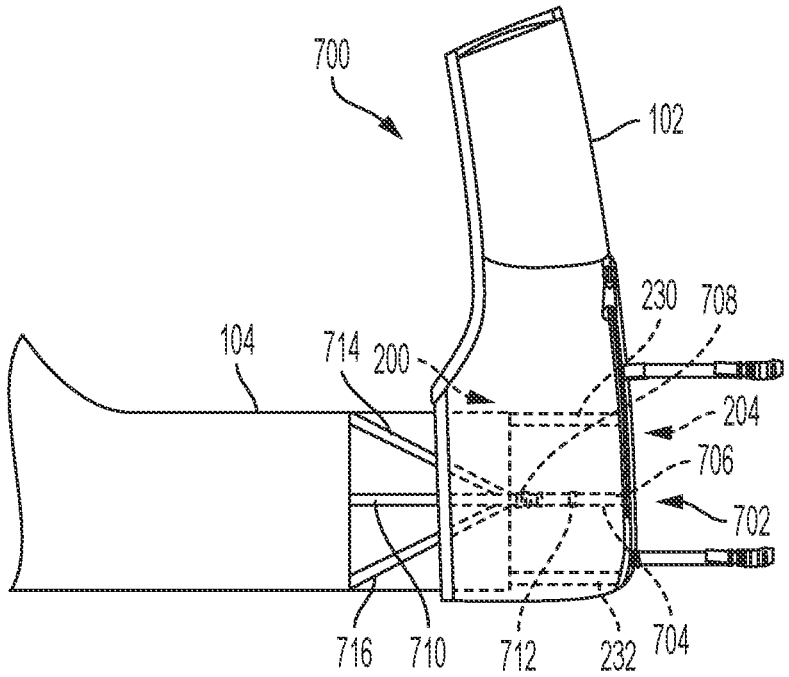
FIG. 7A is a side view of a size-adjustable garment according to another embodiment of the present disclosure.
Figure 7B:
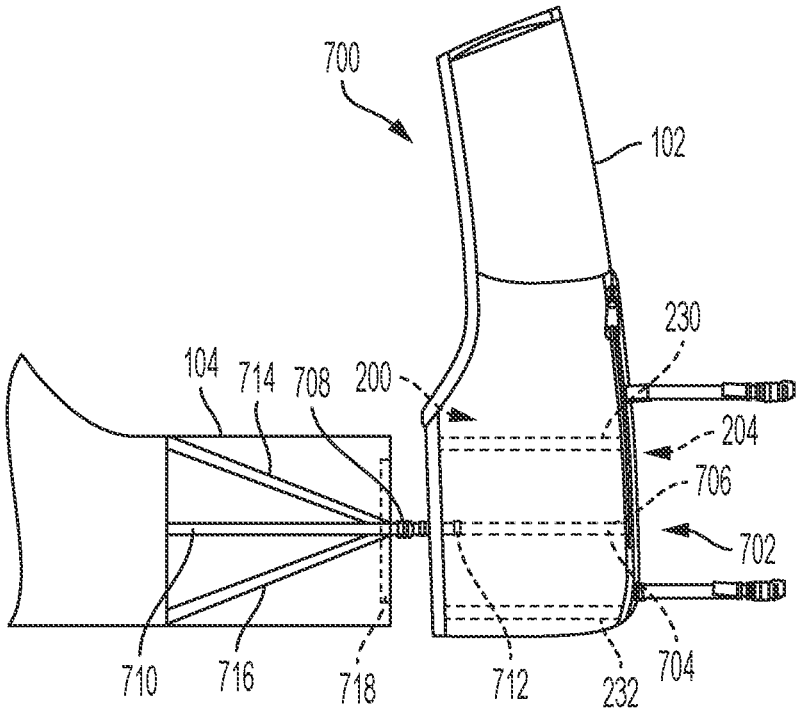
FIG. 7B is a partially-exploded side view of the size-adjustable garment of FIG. 7A.

As another specific example, FIGS. 7A and 7B illustrate a size-adjustable garment 700 according to another embodiment of the present disclosure. The size-adjustable garment 700 may include the same components, or substantially the same components, as the garment 100, except for an adjustment system 702 that facilitates moving the second garment portion 104 relative to the first garment portion 102. Generally, the adjustment system 702 includes the upper guide strap 230 and the lower guide strap 232 described above. The adjustment system 702 also includes an adjustment strap 704 (for example, a textile strap) that is pullable by the wearer to move the second garment portion 104 into the pocket 200. The adjustment strap 704 is disposed within the pocket 200 and includes a first end 706 that couples to the first garment portion 102 (for example, via stitching (not shown), adhesives, ultrasonic welding, or the like) near the second opening 204 of the pocket 200. The adjustment strap 704 extends from the first end 706 toward the second garment portion 104 and through a sliplock buckle 708. The sliplock buckle 708 is coupled to an intermediate guide strap 710 (for example, a textile strap), which is in turn coupled to the second garment portion 104. The adjustment strap 704 extends from the sliplock buckle 708 away from the second garment portion 104 and terminates at a free second end 712. The second end 712 of the adjustment strap 704 may be pulled by the wearer away from the second garment portion 104 to tighten the fit of the garment 700 on the wearer. To loosen the fit of the garment 700 on the wearer, the sliplock buckle 708 may be pivoted to permit the adjustment strap 704 to slide therethrough. The adjustment system 702 also includes a first, diagonally-extending, support strap 714, a second, diagonally-extending, support strap 716, and a third, vertically-extending, support strap 718 (see FIG. 7B) that are coupled to the second garment portion 104 and inhibit the second garment portion 104 from deforming when moving relative to the first garment portion 102.

Figure 8:
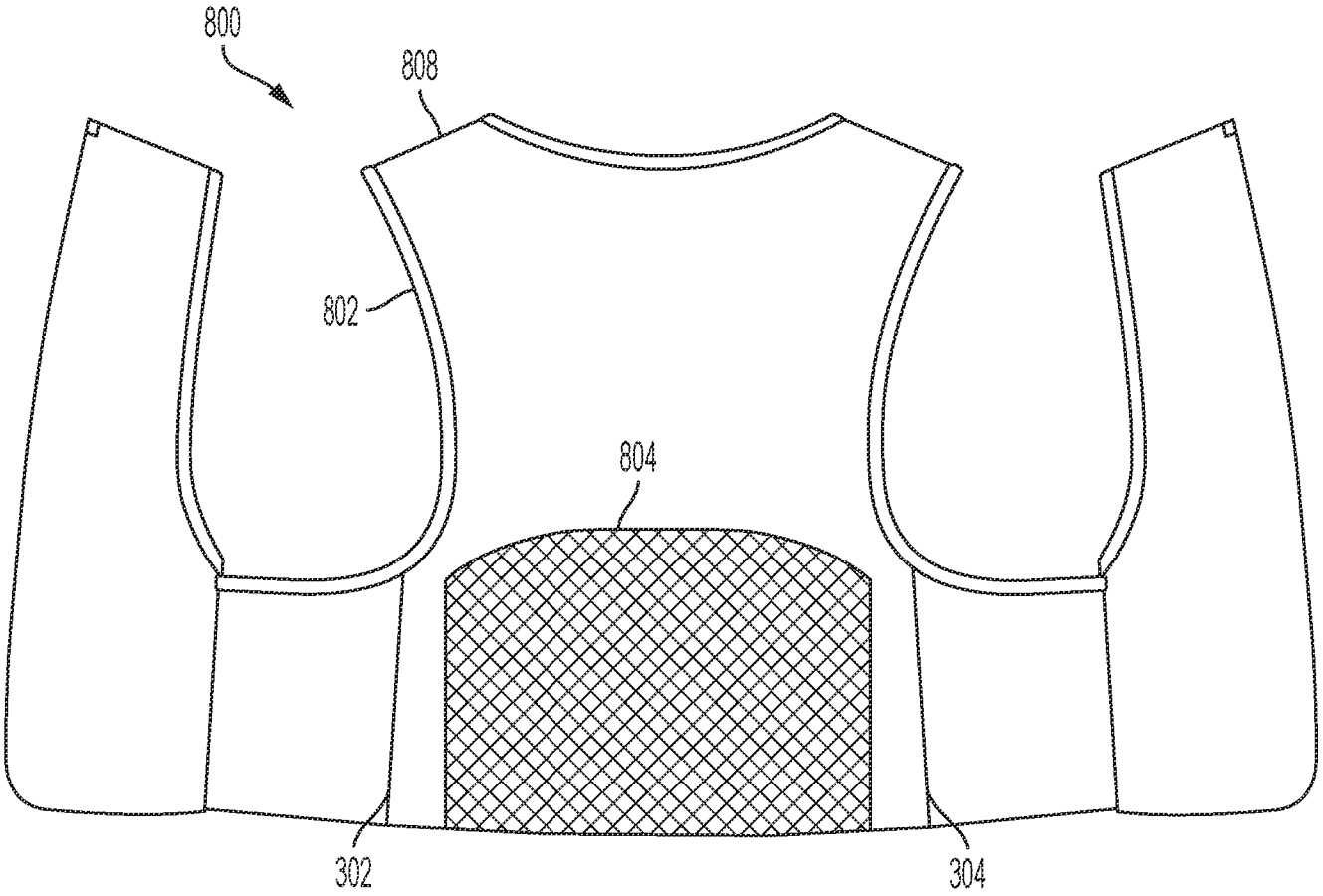
FIG. 8 is a partially-exploded front view of an interior of a size-adjustable garment according to another embodiment of the present disclosure.

As another example, the third garment portion of size-adjustable garments according to the present disclosure may take various other forms. As a specific example, FIG. 8 illustrates a size-adjustable garment 800 according to another embodiment of the present disclosure. The size-adjustable garment 800 may include the same components, or substantially the same components, as the garment 100, except for a third garment portion 802 that is configured to engage the back of the torso of the wearer. Generally, the third garment portion 802 includes a relatively-elastic section 804 and a relatively-inelastic section 806, which may include the same materials as the relatively-elastic section 308 (shown elsewhere and described above) and the relatively-inelastic section 312 (shown elsewhere and described above), respectively. However, the relatively-elastic section 804 is smaller compared to the relatively-elastic section 308. More specifically, the relatively-elastic section 804 is offset from the stitching 302, 304.

Figure 9:
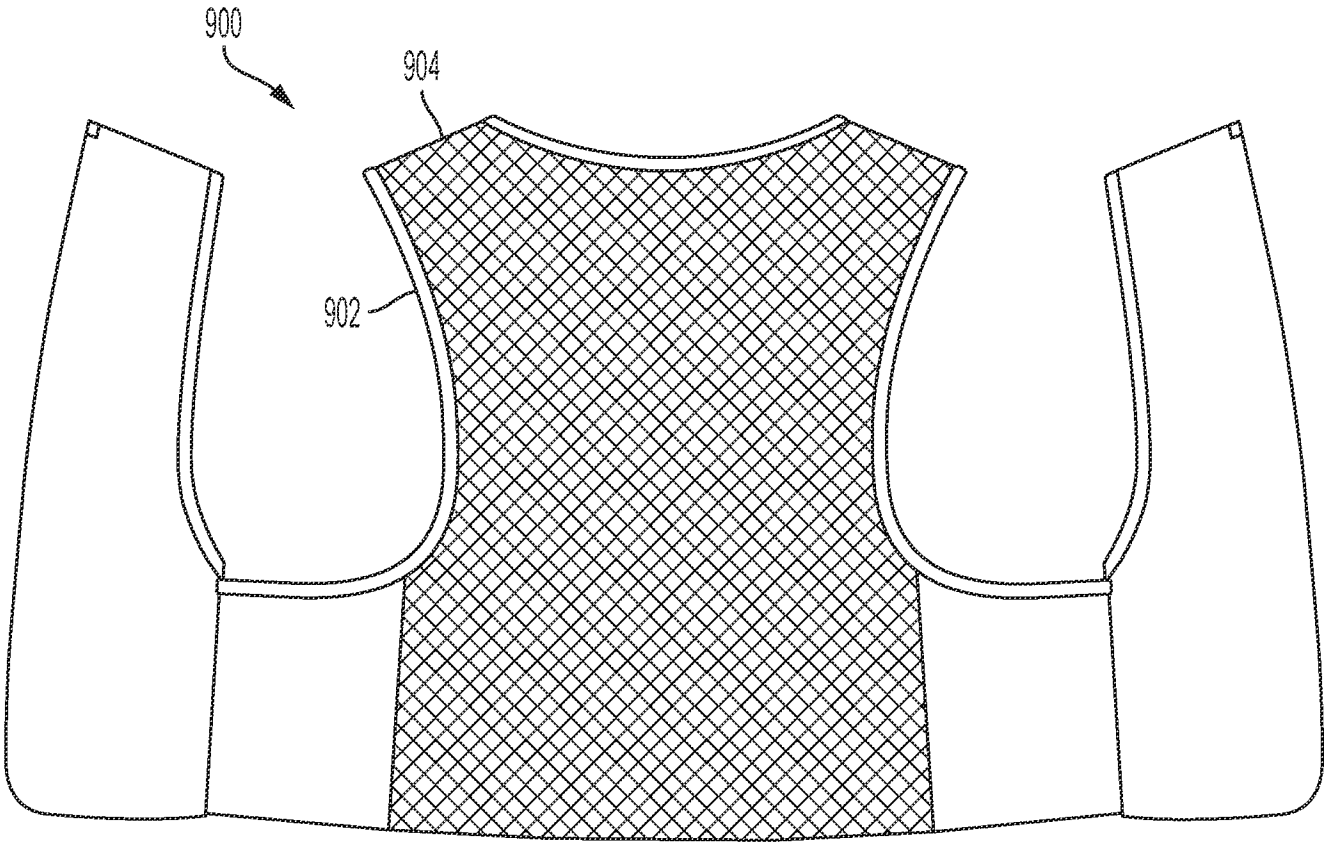
FIG. 9 is a partially-exploded front view of an interior of a size-adjustable garment according to another embodiment of the present disclosure.

As another specific example, FIG. 9 illustrates a size-adjustable garment 900 according to another embodiment of the present disclosure. The size-adjustable garment 900 may include the same components, or substantially the same components, as the garment 100, except for a third garment portion 902 that is configured to engage the back of the torso of the wearer. Generally, the third garment portion 902 includes a relatively-elastic section 904, which may include the same materials as the relatively-elastic section 308 (shown elsewhere and described above). However, the third garment portion lacks the relatively-inelastic section 312 (shown elsewhere and described above).

Embodiments of size-adjustable garments according to the present disclosure may vary from those described above and shown in the drawings in other manners. For example, the pocket of the first garment portion could lack the medial opening. As another example, one or more of the first garment portion, the second garment portion, the third garment portion, the fourth garment portion, and the fifth garment portion could include one or more additional pockets for carrying items. As another example, one of the first garment portion and the fifth garment portion could include an adjustment system, and the other of the first garment portion and the fifth garment portion could lack an adjustment system. As another example, the first garment portion and the fifth garment portion could include different types of adjustment systems. As another example, one or more of the guide elements could take other forms. As a specific example, one or more of the guide elements could be cables comprising textile or non-textile materials.

Various other modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A garment configured to be worn by a wearer, the garment comprising:

a front right garment portion and a front left garment portion, the front right garment portion configured to engage a front of the wearer, the front left garment portion configured to engage the front of the wearer, at least one of the front right garment portion and the front left garment portion comprising a pocket, the pocket comprising an opening, and the front right garment portion and the front left garment portion defining a gap between the front right garment portion and the front left garment portion when the garment is worn by the wearer;

an attachment feature spanning the gap and detachably coupling the front right garment portion and the front left garment portion when the garment is worn by the wearer;

a side garment portion configured to engage a side of the wearer, the side garment portion being movable relative to the at least one of the front right garment portion and the front left garment portion; and an adjustment system at least partially disposed within the pocket and coupling the side garment portion and the at least one of the front right garment portion and the front left garment portion, the adjustment system being manipulable by the wearer to move the side garment portion at least partially into the pocket via the opening to thereby adjust a fit of the garment on the wearer, the adjustment system comprising:

a first sliplock buckle coupled to the at least one of the front right garment portion and the front left garment portion;

a second sliplock buckle coupled to the at least one of the front right garment portion and the front left garment portion; and a strap comprising a first end coupled to the side garment portion, a second end coupled to the side garment portion, a handle garment portion disposed between the first end and the second end and between the first sliplock buckle and the second sliplock buckle, the handle garment portion being pullable to move the strap through the first sliplock buckle and the second sliplock buckle to move the side garment portion at least partially into the pocket via the opening to thereby adjust the fit of the garment on the wearer.

2. The garment of claim 1, wherein the adjustment system is manipulable by the wearer to move the side garment portion at least partially into the pocket via the opening to thereby adjust a girth size of the garment on the wearer.

3. The garment of claim 1, wherein the adjustment system is pullable by the wearer to move the side garment portion at least partially into the pocket via the opening to thereby adjust the fit of the garment on the wearer.

4. The garment of claim 1, wherein the adjustment system further comprises a guide element coupled to the at least one of the front right garment portion and the front left garment portion and coupled to the side garment portion, the guide element slidably extending through an aperture on the at least one of the front right garment portion and the front left garment portion.

5. The garment of claim 4, wherein the guide element is a guide strap.

6. The garment of claim 1, further comprising a back garment portion configured to engage a back of the wearer.

7. The garment of claim 6, wherein the side garment portion comprises a first material having a first elastic modulus, the back garment portion comprises a second material having a second elastic modulus, and the second elastic modulus is less than the first elastic modulus.

8. The garment of claim 4, wherein the guide element is a first guide element, and the garment further comprising a second guide element coupled to the at least one of the front right garment portion and the front left garment portion and coupled to the side garment portion.

9. The garment of claim 8, wherein the first guide element is a first guide strap and the second guide element is a second guide strap.

10. The garment of claim 8, further comprising a third guide element coupled to the side garment portion and coupled to the at least one of the front right garment portion and the front left garment portion.

11. The garment of claim 10, wherein the first guide element is a first guide strap, the second guide element is a second guide strap, and the third guide element is a third guide strap.

12. The garment of claim 1, wherein the opening is a first opening, the pocket further comprising a second opening.

* * * * *